US007059256B2

(12) United States Patent
Ingvarsson

(10) Patent No.: US 7,059,256 B2
(45) Date of Patent: Jun. 13, 2006

(54) COMBUSTION DEVICE

(75) Inventor: Robert Ingvarsson, Åmål (SE)

(73) Assignee: Swedish Bioburner System Aktiebolag, Amal (SE)

( * ) Notice: Subject to any disclaimer, the term of this patent is extended or adjusted under 35 U.S.C. 154(b) by 0 days.

(21) Appl. No.: 10/475,833

(22) PCT Filed: Apr. 26, 2002

(86) PCT No.: PCT/SE02/00824

§ 371 (c)(1),
(2), (4) Date: Oct. 24, 2003

(87) PCT Pub. No.: WO02/088597

PCT Pub. Date: Nov. 7, 2002

(65) Prior Publication Data

US 2004/0134397 A1 Jul. 15, 2004

(30) Foreign Application Priority Data

Apr. 26, 2001 (SE) ..... 0101457

(51) Int. Cl.
*F23B 5/00* (2006.01)
*F23D 1/00* (2006.01)

(52) U.S. Cl. ..... 110/210; 110/265; 110/347

(58) Field of Classification Search ..... 110/213, 110/210, 265, 264, 347, 308, 246, 276, 275, 110/207, 115, 211, 212, 214, 342, 344; 431/352, 431/10, 351, 185
See application file for complete search history.

(56) References Cited

U.S. PATENT DOCUMENTS 1,819,555 A * 8/1931 Herschell ..... 110/277

(Continued)

FOREIGN PATENT DOCUMENTS

| | | |
|---|---|---|
| FR | 2 671 166 | 12/1990 |
| WO | WO 94/17331 | 1/1994 |
| WO | WO 97/49951 | 6/1997 |

(Continued)

OTHER PUBLICATIONS

International Preliminary Examination Report dated Apr. 26, 2002 for PCT/SE02/00824 and PCT Request.

*Primary Examiner*—Kenneth Rinehart
(74) *Attorney, Agent, or Firm*—Kilpatrick Stockton LLP

(57) ABSTRACT

The invention relates to an arrangement (1) for the combustion of granular, solid fuel, for example wood-flour pellets, chips and the like, comprising a preferably horizontal combustion chamber (16), a dispensing unit (3) for feeding the fuel into the combustion chamber via fuel feed pipe (15), air inlets (22, 23) with blower (18) for the delivery of primary air (P) to the combustion chamber via at least one air duct or air chamber (24, 25) in order to produce a flow of air through the combustion chamber and the fuel for a primary combustion of the fuel to combustion gases, and for the delivery of secondary air (S) to a secondary combustion chamber (26) via a secondary air distributor (26A) in order to produce a secondary combustion of the combustion gases formed in the primary combustion together with a common outlet (47) for the primary air, the combustion gases and the secondary air from the secondary combustion chamber to a boiler space (12) in a broiler (2) for transmitting the heat from the said primary and secondary combustion to the heat supply system of the boiler. According to the invention the secondary air distributor also comprises a fan (49) for producing an air and combustion gas vortex (50) inside the secondary combustion chamber and on out through the outlet (47) to the boiler space. The invention also relates to a method of combustion comprising such a combustion arrangement.

32 Claims, 6 Drawing Sheets

U.S. PATENT DOCUMENTS

| | | | | | |
|---|---|---|---|---|---|
| 4,565,137 | A | * | 1/1986 | Wright | 110/264 |
| 4,597,342 | A | * | 7/1986 | Green et al. | 110/347 |
| 4,630,554 | A | * | 12/1986 | Sayler et al. | 110/264 |
| 5,680,822 | A | * | 10/1997 | Hallberg | 110/261 |

FOREIGN PATENT DOCUMENTS

| | | | | |
|---|---|---|---|---|
| GB | 2198519 | A | * | 6/1988 |
| GB | 2 079 910 | A | | 7/1990 |
| SE | 450 734 | | | 12/1982 |

* cited by examiner

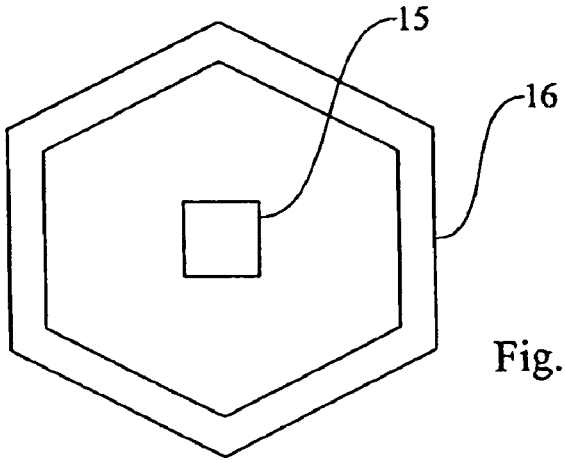
Fig. 7
Fig. 8
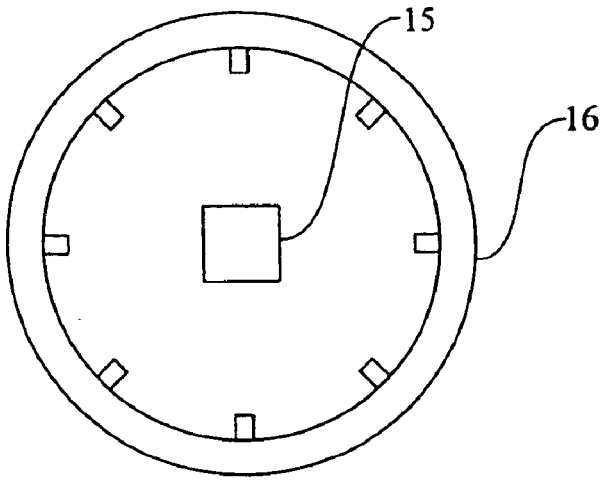
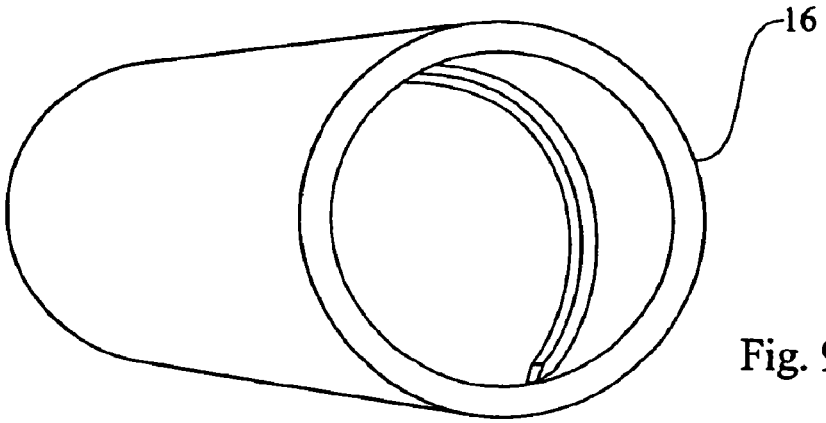
Fig. 9

COMBUSTION DEVICE

TECHNICAL FIELD

The present invention relates to an arrangement for the combustion of granular, solid fuel, for example wood-flour pellets, chips or the like, comprising a preferably horizontal combustion chamber, a dispensing unit for feeding the fuel into the combustion chamber via a fuel feed pipe, air inlets with blower for the delivery of primary air (P) to the combustion chamber via at least one air duct or air chamber in order to produce a flow of air through the combustion chamber and the fuel for a primary combustion of the fuel to combustion gases, and for the delivery of secondary air (S) to a secondary combustion chamber via a secondary air distributor in order to produce a secondary combustion of the combustion gases formed in the primary combustion, and a common outlet for the primary air (P), the combustion gases and the secondary air (S) from the secondary combustion chamber to a boiler space in a boiler for transmitting the heat from the said primary and secondary combustion to the heat supply system of the boiler.

The invention also relates to a method of combustion comprising such a combustion arrangement.

PROBLEM AND BACKGROUND OF THE INVENTION

Combustion arrangements, hereinafter also referred to as burners, for solid fuel of the aforementioned type are known in various embodiments. Common to burners is the fact that they are suitably intended for fitting to some type of more or less conventional boiler, which suitably has a water-based heat supply system comprising the usual radiators, either as a complement to or as an alternative to the ordinary oil burner.

Some examples of these or essentially similar burners are disclosed by the patent publications WO 94/17331, WO 97/49951, SE-B-450 734 and GB-A-2 079 910, in which solid fuel burners are shown, which are fitted to a boiler so that the front section of the burner is introduced into the hearth of the boiler through the outer casing of the boiler. The said burners comprise a combustion chamber in which the solid and suitably granular fuel, in the form of pellets, for example, is rotated during introduction of the combustion air. Even larger solid fuel combustion plants are disclosed, for example, by the Swedish patent specification SE-C-63 193, which shows a furnace especially for the combustion of municipal refuse. The latter combustion arrangement also comprises a rotatable cylinder which functions as fuel grate.

In such combustion arrangements the fuel is therefore rotated with a simultaneous delivery of combustion air that contains the oxygen needed to bring about a primary combustion of the fuel. Fuel pellets normally consist of approximately 10% water and approximately 12% pure carbon, whilst the remainder of the pellets largely consists of various hydrocarbon compounds. The content of the pellets varies greatly, however. During the primary combustion hot combustion gases are formed on the one hand, together with ashes and other solid slag products on the other. The greater part, estimated at approximately 80 to 90%, of the ashes are entrained with the air flow through the burner as fly ash, which is precipitated out of the combustion gases outside the burner and inside the actual boiler. It is desirable for 100% of all ashes to be precipitated outside the burner, which normally occurs if the melting point of the ashes exceeds the temperature range at which the burner is intended to function, for example if the melting point of the ashes exceeds an operating temperature normally in the order of 1100° C., and if the air flow is sufficient. It has proved difficult, however, to obtain complete combustion of the fuel to secondary combustion gases, that is to say to achieve a fuel gasification of 100%. In combustion at temperatures in excess of the melting point of the ashes the original light, powdery ashes are in fact converted to pieces of fused heavier material, so-called sintering, which are not as readily entrained with the combustion gases out of the burner. In the combustion of impure fuel with excessively high contents of certain substances having inferior or deteriorating combustion characteristics the sintering also occurs at lower temperatures than the 1100° C. quoted, which further aggravates the problem of sintering.

In the burners currently known a substantial proportion of the sinter is therefore precipitated right in the actual combustion chamber, so that an accumulation of ashes, unburned pellets and sinter slag is formed, which obstructs the air inlet openings needed for the flow of air through the fuel bed into the combustion chamber. The obstruction of the air inlet openings results in impaired and uneven combustion of the fuel, so that more air must be added. This makes the burner less efficient, since the combustion gases are diluted and since the extra air delivered also has a cooling effect. The accumulation of ashes, pellets and slag grows quite rapidly to a greater height, which in turn can mean that the position of the fuel bed is shifted to a position that is not conducive to functioning, whilst the risk of burn-back also increases dramatically, that is to say the centre of the fire is raised towards and into the fuel feed pipe. This makes the sintering both technically awkward and moreover dangerous.

Non-rotating combustion chambers increase the aforementioned problems since the static nature of the combustion chamber means that the slag formation all the time occurs in the same area of the combustion chamber and since the automatic discharge normally performed in rotating combustion chambers by means of likewise rotating, screw-shaped discharge flanges is absent. Stationary combustion chambers therefore either require more frequent cleaning or a specially arranged cleaning device, such as an ash rake. In many boilers there is a container in the form of a box inside the boiler, in which box the ashes land since the front part of the burner is nested in the actual boiler. The ashes in the box are emptied either manually or by extracting the ashes by means of a suction device. The ash box may be relatively large. Therefore, it can be emptied relatively infrequently without causing difficulties.

In rotating combustion chambers the accumulation of ashes and sinter slag is therefore fed towards the outlet from the burner by means of similarly rotating discharge flanges. The accumulation also contains unburned pellets and other solid, not yet fully combusted products, however, which still have a substantial energy content. In order to also utilise the energy content of these products, the combustion chamber is therefore often designed with a convex longitudinal section by giving the walls of the combustion chamber a design diverging towards the front, open end of the burner. Alternatively, the burner may be provided with one or more edge flanges, which prevent the said products passing through the burner unburned. The patent publication WO 97/49951, for example, shows a burner having both an inner edge flange, which partially closes the outlet opening of the combustion chamber to a secondary combustion chamber arranged immediately outside this combustion chamber, and an outer annular edge flange, which partially closes the outlet opening of the secondary combustion chamber. In order to achieve combustion of the residual products in the secondary combustion chamber, there are secondary air inlet openings for secondary air arranged in the inner edge flange.

Since the partially closed construction of the burner not only prevents unburned residual products passing through the burner, but also impedes the flow of fly ash out of the combustion chamber, there is a greater risk that slag products will be formed inside the said combustion chamber and secondary combustion chamber at excessively high combustion temperatures. The secondary combustion chamber, moreover, entirely lacks any discharge flanges.

It will be appreciated therefore that one problem for solid fuel burners is the formation of sinter inside the actual combustion chamber and any secondary combustion chamber. It will furthermore be realised that in combustion arrangements with non-rotating combustion chamber without any automatic discharge of the slag products formed, in burners with combustion chambers having a convex longitudinal section or an outlet opening for the combustion gases which is smaller than the combustion chamber and/or the secondary combustion chamber itself the aforementioned problems increase very markedly.

There is therefore a desire for the burner to function over a longer period of time without special manual or automated burner cleaning measures. Instead, measures must be taken in the design of the burner in order to eliminate or at least substantially reduce the said sintering or to get the sintering of the ashes to occur at a safe distance outside the burner. Merely increasing the air flow by means of a larger blower, for example, in order to blow the ashes away might have undesirable effects on the fuel consumption, the efficiency and the temperature that are required in order to achieve an optimum operating cost.

A further problem is that the burner, and in the case of a rotating burner its bearing, may be damaged by excessively high temperatures. The specification GB-A-2 079 910 identifies this problem and states that the double-walled burner shown in the said specification has two purposes; firstly to deliver air to the combustion chamber and secondly to provide thermal insulation, that is to say air cooling of the combustion chamber bearings. The specification omits secondary combustion chambers.

In the case of existing burner design constructions, extensive and time-consuming work must be carried out in order to replace or repair a combustion chamber or secondary combustion chamber that has been burnt through. The main reason for the inside walls of combustion chambers and secondary combustion chambers becoming deformed and holes appearing in these is thought to be due to the fact that the flame jet generated by the burning combustion gases and the air delivered by the blower occurs at too short a distance from the said inside walls. One desire therefore is to be able to shift or definably limit the centre of combustion and hence the "volume" of the flame jet, that is to say the axial and radial temperature distribution of the flame jet from the said centre.

It will naturally be appreciated that even such a burner, that is to say a burner with a flame jet that can be controlled in the aforementioned way, has a limited life span, following which the combustion arrangement must dismantled so that combustion parts of the combustion arrangement, including at least the combustion chamber and secondary combustion chamber, must be replaced. Such replacement is costly and time-consuming since new parts still cannot be installed efficiently enough and since the replaced parts in the known design constructions represent an unnecessarily large part of the combustion arrangement.

OBJECT AND CHARACTERISTICS OF THE INVENTION

An object of the present invention is to provide an arrangement for the combustion of granular, solid fuel, which arrangement substantially reduces or completely eliminates the aforementioned problems, it being possible to make better use of the favourable effects of the solid fuel burner than hitherto, whilst simplifying the design of the burner, making it cheaper to manufacture and substantially easier to keep clean and maintain.

The combustion arrangement according to the invention is characterised in that the secondary air distributor also comprises a fan for producing an air and combustion gas vortex inside the secondary combustion chamber and on out through the outlet to the boiler space.

According to further aspects of an arrangement according to the invention:

- the combustion arrangement also comprises a drive motor for a continuous or intermittent rotation of the fan.
- the drive motor is also designed to rotate the combustion chamber and secondary combustion chamber.
- the fuel feed pipe, the combustion chamber, the existing air inlets and the air chambers are arranged concentrically in relation to one another with a common axis.
- the fan comprises a plurality of fan blades, which are arranged in the secondary air distributor.
- the fan blades are arranged around the circumference of the secondary air distributor.
- the fan blades have a specific axial and/or radial angle to a plane along the axis of rotation.
- the combustion arrangement comprises separate air ducts or air chambers for the primary air (P) and the secondary air (S).
- at least the combustion chamber has an internal cross-section which is polygonal and/or is provided with longitudinal or helical vanes for tumbling of the fuel as the combustion chamber rotates.
- the combustion arrangement comprises two circular cylindrical drums, which are arranged concentrically in tandem on the outside of the air inlet pipe, the air ducts or the air chamber respectively, to form an outer air inlet pipe and outer air ducts or air chamber for the delivery of secondary air (S) to the secondary combustion chamber via the secondary air distributor, whilst only primary air (P) is delivered to the combustion chamber via the air inlet pipe and the air ducts or the air chamber.
- the secondary air distributor comprises an inner and an outer edge flange, which inner edge flange and inner boundary wall of the combustion chamber, and outer edge flange and outer wall of the combustion part, are respectively arranged at a certain angle $\alpha$, $\beta$ to one another of between approx. 90° and 180°, preferably between approx. 90° and 135°, and which angles $\alpha$, $\beta$ may be of different size in relation to one another.

The combustion method involving a combustion arrangement according to the invention is characterised in that the fan creates an outwardly directed air and combustion gas vortex, which shifts a substantial part of the secondary combustion (S) and the centre of secondary combustion to a specific distance from the combustion chamber outlet and preferably outside and at a distance from the combustion part of the combustion arrangement.

According to further aspects of a method according to the invention:

the outwardly directed air and combustion gas vortex that is created by the fan blows solid and gaseous combustion products out of the combustion chamber and the secondary combustion chamber with simultaneous secondary combustion of these products, and since a substantial part of the secondary combustion thereby takes place outside the combustion arrangement the hottest part of the fire is shifted away from the combustion chamber and away from the walls of the secondary combustion chamber, so that these are exposed to a lower temperature and the slag products formed in the hottest part of the fire will be precipitated outside the combustion arrangement and fall down into the boiler space of the boiler. In order to shift the fire away from the walls of the secondary burner, the secondary air is directed radially inwards.

an air and combustion gas vortex of definable axial extent, diameter, temperature, circulation speed and heat content is created by means of the fan and the blower.

ADVANTAGES OF THE INVENTION

The combustion arrangement according to the invention ensures that any unburned fuel residues are discharged from the combustion chamber, together with the combustion gases formed by the primary combustion in the combustion chamber, into the secondary combustion chamber, from whence these residues and gases are also blown very powerfully out of the combustion arrangement and over to the boiler space of the boiler. Simultaneously with this blown discharge, the said residues are also very efficiently gasified into further combustion gases and fly ash in the secondary combustion chamber and in the flame jet, also referred to as the cyclone, which is created there. The said fly ash and the slag products normally formed in the hottest part of the fire fall down into the boiler ash container, which prevents the fly ash formed in the combustion being converted to sinter deposits inside the actual burner. Owing to the cyclone effect, the major part of the secondary combustion therefore takes place outside the burner and at a distance from the walls of the secondary combustion chamber, so that the hottest part of the fire is shifted away from the wall of the secondary combustion chamber, so that this is exposed to a lower temperature, thereby countering unanticipated damage and additional wear. The combustion arrangement according to the invention represents a very simple design construction having few parts. The burner is primarily intended to replace an oil burner in a conventional oil-fired boiler. The combustion arrangement according to the invention is small, easy to manage and very efficient, making the burner both inexpensive to manufacture and also very reliable. The risk of burn-back is also virtually eliminated. According to certain aspects of the invention, a combustion arrangement is moreover obtained which is easier and very much cheaper to service and repair. The physical characteristics of the flame jet, such as its axial and radial extent (volume), position and direction, and its temperature distribution within the said volume can be predetermined through the design of the secondary air distributor.

DESCRIPTION OF THE DRAWINGS

The invention will be described in more detail below with reference to the drawings attached, in which:

FIG. 7 shows a polygonal cross section of the combustion chamber.

FIG. 8 shows a cross section of the combustion chamber that has vanes.

FIG. 9 shows, in perspective, the combustion chamber with a helical vane.

DETAILED DESCRIPTION OF THE EMBODIMENTS

Figure 1:
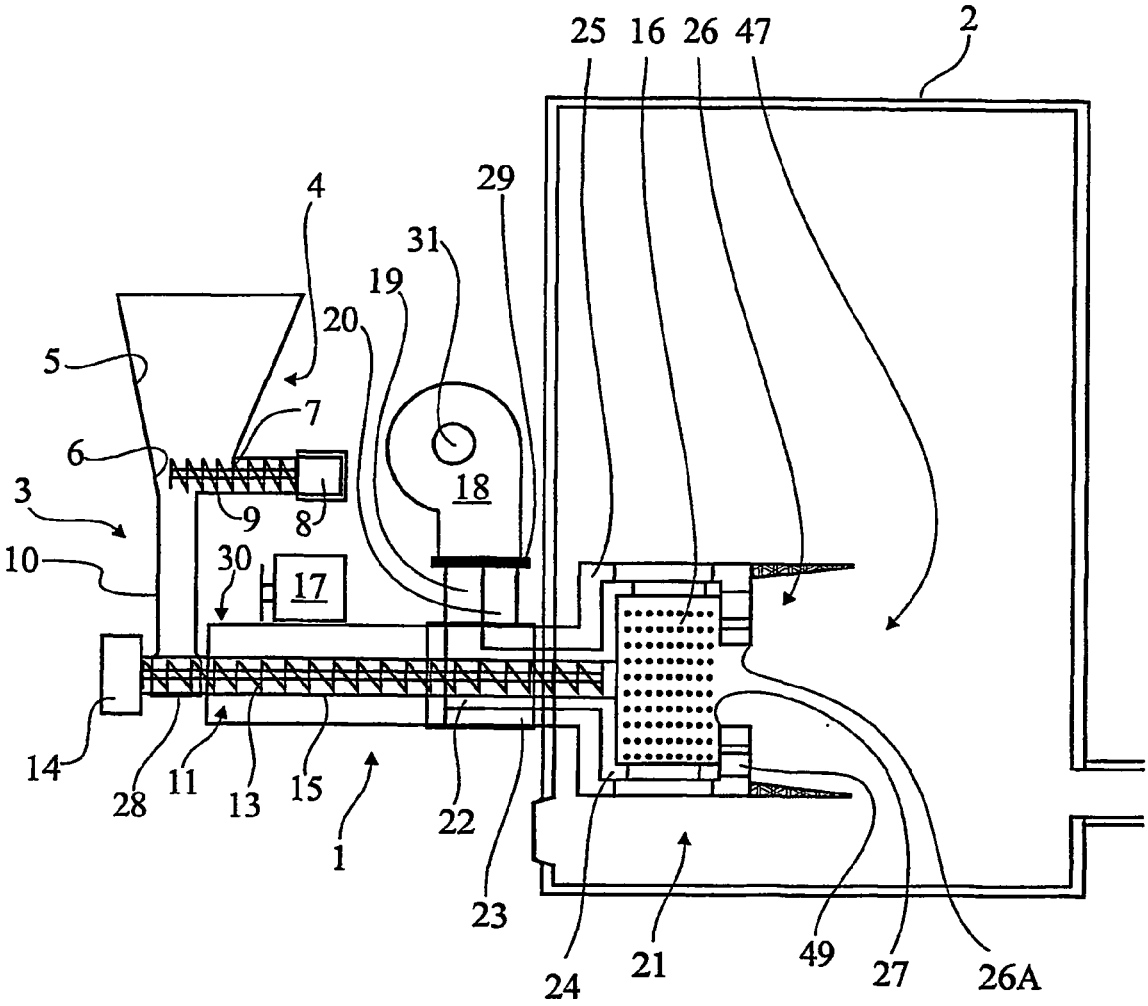
FIG. 1 is a diagrammatic cross-section through parts of an arrangement for the combustion of granular, solid fuel according to the present invention, the combustion arrangement being fitted to a conventional boiler.

Referring to FIG. 1; this shows a diagrammatic a cross-section through parts of an arrangement 1 according to the present invention for the combustion of granular, solid fuel, the combustion arrangement 1 being fitted to a conventional boiler 2 for heating a building (not shown), for example. The said granular, solid fuel consists, for example, of compressed wood-flour pellets or briquettes, chips or the like having a suitable diameter of approx. 6 to 12 mm. The combustion arrangement 1 further comprises a dispensing unit 3 and a smaller fuel store 4 incorporated in the actual dispensing unit 3, which smaller fuel store 4 can either be topped up manually, in which case normally a couple of times a week or automatically (not shown) via at least one fuel conveyor from a fuel store detached from the dispensing unit, which is suitably arranged at a distance from the said dispensing unit 3. In order to obtain an even delivery of the fuel in question and to prevent the fuel forming an accumulation of fuel preventing further conveying of the fuel, the said smaller fuel store 4 suitably has somewhat inclined boundary surfaces 5, which form a hopper mouth 6 open at the bottom, at which hopper mouth 6 a screw conveyor 7 is also arranged. The dispensing unit 3 comprises a motor 8 with gearbox for driving the screw conveyor 7, which is rotatably arranged in an essentially horizontal, suitably rigid feed pipe 9 in order to automatically discharge the fuel via the hopper mouth 6 of the fuel store 4 and on down via a suitably vertical or essentially vertically inclined, rigid down-pipe or flexible down-hose 10 to an essentially horizontally arranged fuel feed device 11 in the combustion arrangement 1. The boiler 2 also comprises a water-based heat supply system (not shown in more detail), for example a water-based circulation system provided with radiators, having water-cooled surfaces arranged inside the boiler 2. In the embodiments shown in the figures the combustion arrangement 1 is arranged essentially horizontally, but in other embodiments, not shown, the combustion arrangement 1 may instead be arranged with a certain vertical inclination in relation to the boiler space 12 of the boiler.

The fuel feed device 11 further comprises a screw conveyor 13 with drive motor 14, the screw conveyor 13 being rotatably arranged inside a fuel feed pipe 15 for automatic dispensing of the fuel from the down-pipe or down-hose 10 of the dispensing unit 3 and on into a combustion chamber 16, which in the embodiment shown is arranged essentially horizontally. The fuel feed pipe 15, which opens out at the centre of rotation of the combustion chamber 16, has a circular cross-section and also functions as axis of rotation of the rotating parts of the combustion arrangement 1. A drive motor 17 for the rotation of these parts is shown in diagrammatic form in FIG. 1. The fact that the fuel feed pipe 15 opens out at the centre of rotation of the combustion chamber 16 means that fuel is delivered centrally. Air can then be delivered radially outside the fuel feed pipe 15. The central fuel feed means that fuel can be delivered at a distance from the combustion chamber 16. Fuel can thereby be delivered to a comparatively cold site. This reduces the risk, for example, of return leakage resulting from the fact that seals are unable to remain tight at high temperatures. This is an advantage of a central feed compared to peripheral feeding of fuel to the combustion chamber 16.

Figure 2:
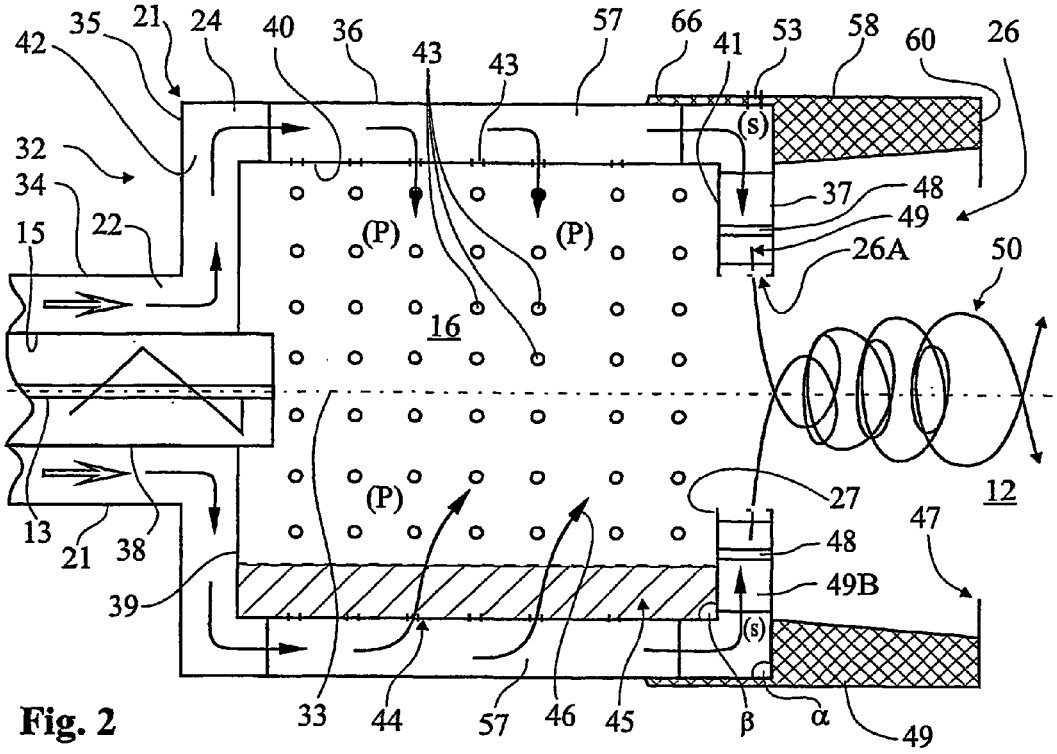
FIG. 2 in a diagrammatic cross-section and on a larger scale shows selected parts of a first embodiment of the combustion arrangement according to FIG. 1, the parts consisting, in particular, of combustion chamber, air inlet, secondary air distributor, secondary combustion chamber, and a front part of a fuel feed pipe which forms part of a fuel dispensing unit.
Figure 3:
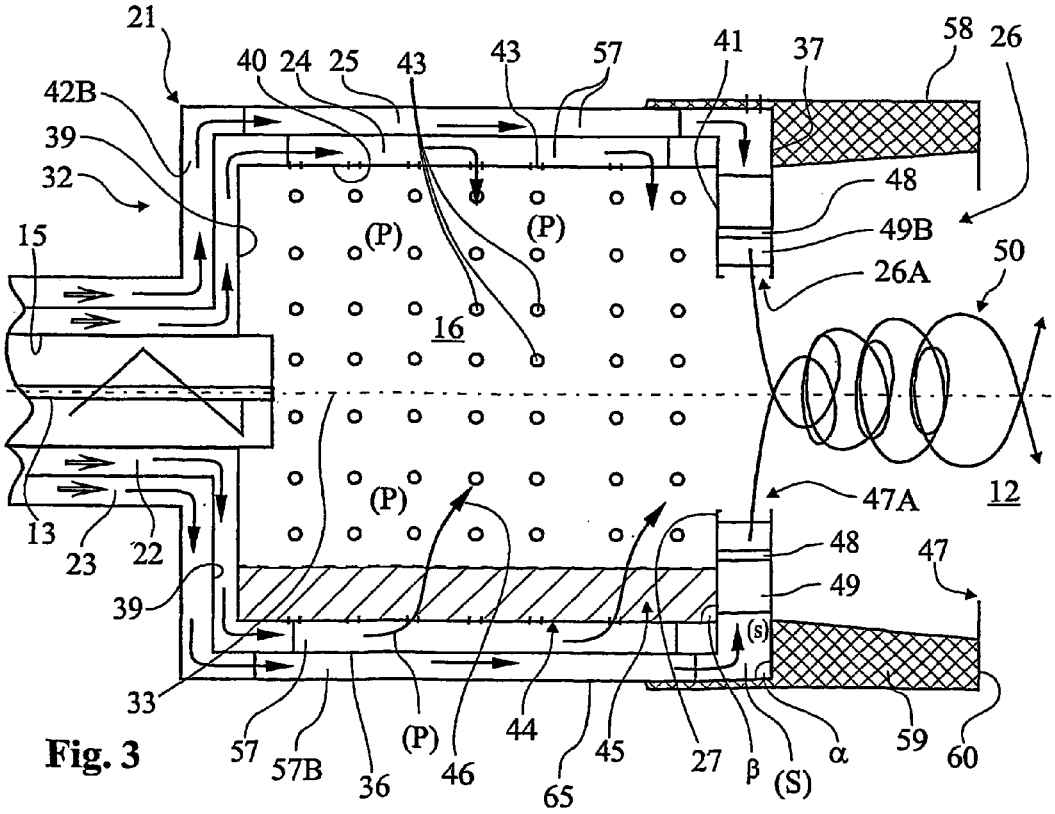
FIG. 3 in a diagrammatic cross-section and on a larger scale shows selected parts of a second embodiment of the combustion arrangement according to FIG. 1, the second embodiment comprising separate air ducts for primary air (P) and secondary air (S).

The combustion arrangement 1 further comprises at least one blower 18 having at least one air outlet 19, 20 for the delivery of air to the combustion part 21 of the combustion arrangement 1, which is arranged inside the boiler space 12 of the boiler 2, via one or more air inlet pipes 22, 23 and from the air inlet pipes 22, 23 on via a plurality of essentially elongate air ducts, essentially separated from and parallel to one another, or via one or more air chambers 24, 25, essentially surrounding the fuel feed pipe 15 and the combustion chamber 16, for the delivery of primary air () to the combustion chamber 16 and secondary air (S) to a secondary combustion chamber 26 arranged downstream of the combustion chamber 16, that is to say furthest away from the combustion part 21 of the combustion arrangement 1, see FIGS. 2 and 3, via a secondary air distributor 26A which separates the combustion chamber 16 from the secondary combustion chamber 26. The primary air (P) is intended for a primary combustion of the fuel to combustion gases and for conveying these gases and any fly ash thereby formed from the combustion chamber 16 to the secondary combustion chamber 26 via an outlet 27 arranged through the secondary air distributor 26A between the said two chambers 16, 26. The secondary air (S) is intended for a secondary combustion of the combustion gases and for conveying the combustion gases on into the boiler space 12 of the boiler 2 in order to transmit the combustion heat to the heat supply system of the boiler 2, and also to discharge the fly ash and any other residual products remaining out of the combustion part 21. The secondary air distributor 26A is designed to blow the secondary air radially inwards so that in the secondary combustion chamber 26 the fire will be concentrated and situated at a distance from the wall of the secondary combustion chamber 26.

The connection 28, see FIG. 1, between the down-pipe or the down-hose 10 and the fuel feed pipe 15, and the connection 29 between the air outlet pipes 19, 20 of the blower 18 and the air inlet pipes 22, 23 of the combustion arrangement 1 are arranged in a way suitable for the combustion arrangements 1, not shown further in the figures. For example, the fuel feed and air inlet pipes 15, 22, 23 in question can, at the said connections 28, 29, comprise a plurality of openings (not shown) arranged around the circumference of the pipes 15, 22, 23 for passage of the fuel or the air, whilst the connections 28, 29 themselves each consist of a device (not shown in more detail) surrounding each pipe 15, 22, 23 with a connection opening to the connecting ends of the down-pipe or down hose 10, or of the air outlet pipes 19, 20 respectively.

The blower 18, which in the embodiment shown in FIG. 1 is fitted to the combustion arrangement 1 in proximity to the boiler 2, may naturally also be arranged in the rear part 30 of the combustion arrangement 1, that is to say at a greater distance from the boiler 2. The blower 18 has a suitably silent running and speed-controlled motor 31 with a built-in thermal contact which breaks in the event of overload.

Figure 4A:
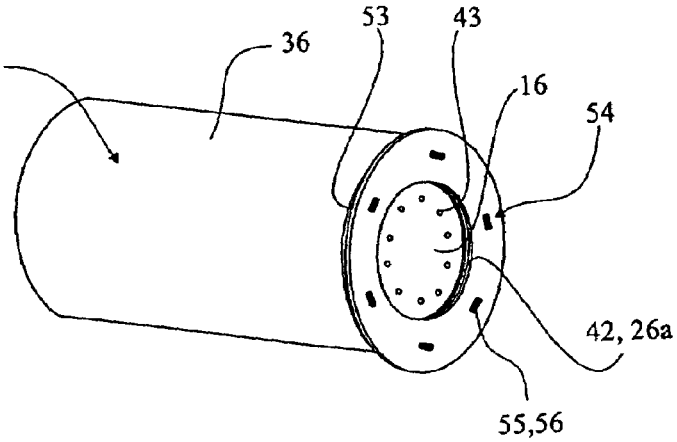
FIGS. 4*a–c* show diagrammatic perspective views of selected parts of the combustion arrangement according to FIGS. 1 to 3.

The embodiments of the combustion part 21 of the combustion arrangement 1 shown in FIGS. 2 and 3 will be described in more detail below. For certain parts, see also FIGS. 4*a–c*.

In the first embodiment, see FIG. 2, the combustion part 21 of the combustion arrangement 1 comprises the combustion chamber 16, the secondary air distributor 26A, the secondary combustion chamber 26, the fuel feed pipe 15 with the screw conveyor 13, just one common air inlet pipe 22 for both primary air (P) and secondary air (S), the air inlet pipe 22 surrounding the fuel feed pipe 15, and just one, that is to say a common chamber 24, which surrounds the combustion chamber 16, for the delivery of primary air (P) to the combustion chamber 16 and for the delivery of secondary air (S) via the secondary air distributor 26A to the secondary combustion chamber 26, furthest away from the combustion arrangement 1.

The fuel feed pipe 15, the combustion chamber 16, the secondary combustion chamber 26, the air inlet pipe 22 and the air chamber 24 preferably have an essentially circular cross-section, see FIG. 4, and the said parts 15, 16, 22, 24 are all arranged concentrically in relation to one another with a common axis of rotation 33. In the embodiment shown in FIG. 2, therefore, the combustion part 21 is designed as two circular cylindrical and double-walled drums, suitably made up from so-called shrouds, which are arranged in series along the common axis of rotation 33 and which form the said parts 15, 16, 22, 24, and from the single-walled secondary combustion chamber 26, which is fixed on the outside of and proceeding from the air chamber 24. At least the combustion chamber 16, however, may also have an internal cross-section, which is polygonal, and/or be provided with longitudinal or helical vanes (not shown) for tumbling the fuel as the combustion chamber 16 rotates.

The two double-walled drums 15, 16, 22, 24 of the combustion part 21 comprise air-tight outer walls 34, 35, 36, 37 and inner boundary walls 38, 39, 40, 41 which are arranged at a specific distance from the outer walls 34, 35, 36, 37 in order to form a continuous space between these essentially over the entire length of the combustion arrangement 1 up to the secondary combustion chamber 26. Together therefore, the walls 34, 35, 36, 37, 38, 39, 40, 41 form, from left to right in FIG. 2, the tubular air inlet pipe 22 on the outside of the fuel feed pipe 15, a double-walled, radially circular space 42 arranged around the fuel feed pipe 15 and constituting a first part of the air chamber 24, which space 42 extends radially outwards from the said air inlet pipe 22 and which space 42 connects with this pipe 22 for an even distribution of the combustion air along the entire rear wall 39 of the combustion chamber 16, the double-walled, circular cylindrical second part of the air chamber 24, which surrounds the cylindrical fuel chamber 16, and finally the secondary air distributor 26A which is designed to blow secondary air radially inwards. One or more, or all of the inner boundary walls 39, 40, 41 of the combustion chamber has/have a plurality of evenly distributed perforations, which form air inlet openings 43 for the through-flow of primary air (P).

The lower part of the combustion chamber 16 constitutes a rotatable hearth 44 for primary combustion, that is to say the gasification of the fuel, on which hearth 44 a fuel bed 45 rests with intermittent or continuous air through-flow 46. The outlet 27 of the combustion chamber 16 for discharge of the combustion gases through the secondary air distributor 26A into the secondary combustion chamber 26 also constitutes an outlet for any fly ash formed. In a rotating combustion chamber 16 with discharge flanges (not shown) the feasible but highly undesirable accumulation of ash and sinter slag will also be fed towards the outlet 27 of the combustion chamber 16 and on into the secondary combustion chamber 26 via the secondary air distributor 26A. The said accumulation contains solid combustion products not yet completely burned and possibly also a smaller quantity of unburned fuel.

In order to also utilise the energy content of these products, the combustion chamber 16 is provided with an annular edge flange, that is to say the said inner, front boundary wall 41, which prevents the said products, or at least the larger and heavier of these with a high energy content from passing through the combustion chamber 16 unburned. This inner edge flange 41 only partially closes the outlet opening 27 of the combustion chamber 16, however, so that a smaller quantity passes into the secondary air distributor 26A. This has an outer annular edge flange (that is to say the outer, front wall 37), which partially closes the outlet opening 47A of the secondary air distributor 26A to the secondary combustion chamber 26. In the embodiments shown, see FIGS. 2 and 3, both the inner and the outer edge flanges 41, 37 are arranged at a 90° angle to both the inner boundary wall 40 and the outer wall 36 (shown as α, β in FIGS. 3 and 4). The said angles α, β may be varied, however, both or only one of the said angles α, β being given another value of between 90° and 180°, preferably between 90° and 135°, see FIG. 5. The distance between the said edge flanges 41, 37 is only shown diagrammatically and in reality is suitably approx. 5–30 mm in the case of a normal domestic boiler 2. The distance interval obviously varies according to which boiler the combustion arrangement 1 is fitted to, depending, for example, on its size, desired output etc. By arranging the secondary air distributor 26A between the inner front boundary wall 41 of the combustion chamber 16 and the outer annular edge flange (that is to say the outer, front wall 37), the flow of secondary air can be directed radially inwards.

In order to bring about a secondary combustion of the remaining solid residue products and the combustion gases formed in the primary combustion, secondary air inlet openings 48 for the secondary air (S) are arranged between the outer and the inner edge flange 37, 41 around the entire circumference of the secondary air distributor 26A. The distribution of the primary air (P) and secondary air (S) blown in by means of the blower 18 suitably consists of approx. 30% primary air (P) through the combustion chamber 16 and approx. 70% secondary air (S) through the secondary air distributor 26A into secondary combustion chamber 26. The secondary air is led outside the combustion chamber 16 and then delivered radially inwards, i.e. towards the common axis of rotation 33. In the embodiment shown in FIG. 2, the distribution of air between primary air and secondary air can be achieved through suitable choice of dimensions for the air inlet openings 43 in the inner boundary walls of the combustion chamber 26. The air inlet openings 43 then function as restrictors. At a certain flow a specific distribution between primary air and secondary air is then obtained. In the embodiment shown in FIG. 3 there are separate ducts for primary air and secondary air. The distribution between primary air and secondary air can then be achieved by using separate blowers, a first blower for the primary air and a second blower for the secondary air. The flow of secondary air can then be independent of the flow of primary air. Using separate blowers therefore also affords the advantage that an optimum distribution between primary air and secondary air can also be achieved with a varying total air flow. In the embodiment shown in FIG. 3 the secondary air chamber 25 is arranged radially outside the primary air chamber 24. The secondary air is therefore led outside the primary air line and the secondary air is then delivered radially inwards, i.e. towards the common axis of rotation 33, so that combustible material and combustible gases are concentrated towards the centre of the secondary combustion chamber 26, so that the fire is concentrated on the centre of the secondary combustion chamber. Among other things this gives a higher temperature compared to a more diffuse fire. In the embodiment shown in FIG. 2 the secondary air flow will also concentrate the fire towards the centre of the secondary combustion chamber 26.

The secondary air distributor 26A comprises a fan 49 in order to simultaneously expel all solid and gaseous combustion products during the said secondary combustion, so that no residual products can obstruct the air inlet openings 48 from the air ducts or the air chambers 24 to the secondary air distributor 26A and in order to shift the centre of the secondary combustion, and hence the hottest part of the fire, away from the combustion chamber (16) and further into the secondary combustion chamber (26), so that a substantial part of the secondary combustion will also take place inside the boiler space 12 of the boiler 2 and outside and at a distance from the combustion part 21. The fan 49 comprises a plurality of fan blades 49B, which are arranged in the secondary air distributor 26A between the outer and the inner edge flange 37, 41 over the entire circumference of the secondary air distributor 26A. The rotation of the secondary air distributor 26A and hence of the fan 49, the location of the fan blades 49B in the air flow and the use of different angles α, β, see FIG. 5, between the inner edge flange 41 and the inner boundary wall 40, and the outer edge flange 37 and the outer wall 36 creates a very powerful air and combustion gas vortex, hereinafter referred to as a cyclone 50, with a definable axial extent, diameter, temperature, circulation speed and heat content out through the secondary combustion chamber 26. The cyclone 50 is directed outwards from the combustion chamber 16 and radially inwards from the wall of the secondary combustion chamber 26. Furthermore, the location of the fan blades 49B and the angles α, β of the edge flanges 37, 41, see FIGS. 4*b* and 5, also mean that the said cyclone 50 is also obtained in a stationary burner, that is to say in combustion arrangements with a non-rotating secondary air distributor 26A, since the fan blades 49B and the edge flanges 37, 41 constrain the air flow into a directed rotational vortex 50. The fan blades 49B, which preferably extend axially (that is to say parallel) alongside a plane through the axis of rotation 33 but which can also be inclined at a certain axial and/or radial angle to the said plane alongside this axis 33, may consist, for example, of straight rails, curved or undulating blades. The fan blades 49B may be of the same or differing thickness, length and width. The "radial extent" of the fan blades 49B, that is to say perpendicular to the axis of rotation 33 of the burner or at a certain specific radial angle to a plane through the axis of rotation 33, along the surface of the edge flanges 41, is of a specific length, which may be either from edge 51 to edge 52 of the edge flange 41 or only a part of this distance between the edge 52 to the outlet opening 27 and the outside diameter 51 of the edge flange 41. There may be one or more open slots 53 between the outer edge flange 37 and the rest of the combustion part, see FIG. 4*a* In the embodiment shown in FIG. 4*b*, the fan blades 49B are 6 in number but if so required there may obviously be either more or fewer, preferably 2 to 12. Designing the secondary air distributor 26A to blow the secondary air radially inwards, so that the cyclone 50 is directed radially inwards from the wall of the secondary combustion chamber, affords the advantage, among other things, that the fire in the secondary combustion chamber 26 becomes more concentrated. Since the fire is more concentrated, a higher degree of combustion is achieved. In addition, combustion takes place at a greater distance from the wall of the secondary combustion chamber 26. This helps to prevent wear to the wall of the secondary combustion chamber 26, thereby possibly extending the life of the latter. Since combustion is more efficient, a smaller air supply is required. This reduces the volumetric flow of gases, which then have to be emitted through the chimney, for example. A higher level of efficiency is achieved.

Figure 4B:
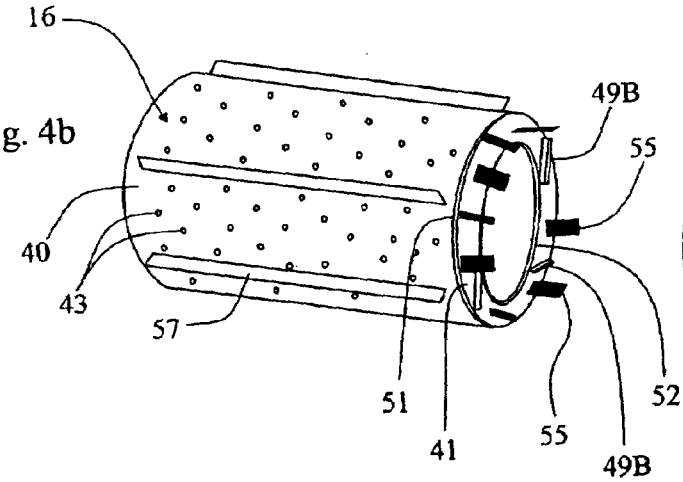
Figure 4C:
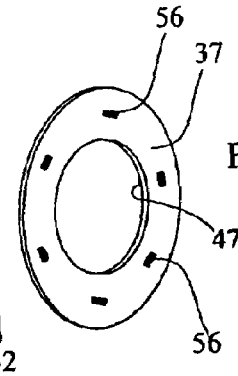

Between inner and outer walls 37, 41 of the secondary air distributor 26A is a fixing device 54 in the form of holding blades 55 and fixing slots 56, for example, designed to facilitate fitting of the outer edge flange 37 to the inner edge flange 41, see FIG. 4. Other known fixing devices or fixing methods are also feasible, however. FIG. 4*b* also clearly shows a number of spacers 57, which are arranged along the combustion chamber 16 between the outer and inner walls 36, 40 of the air ducts or the air chambers 24 in order to maintain the distance between the said walls 36, 40 and to guide the primary air (P) and secondary air (S) in a desired direction towards inlet openings 48 to the secondary air distributor 26A. The secondary combustion chamber 26 comprises an outer casing 58, which in the embodiments shown in the figures take the shape of a cylindrical sheet-metal shroud and an inset 59 of temperature-resistant material, such as ceramic, the inset being fitted inside the casing and between the outer edge flange 37 and an end flange 60. Internally, the inset 59 is suitably shaped as a truncated cone, the inset being thinner at the outer and, in the embodiment shown, somewhat cooler end, which constitutes the outlet opening 47 from the secondary combustion chamber 26 into the boiler space 12.

In the second embodiment, see FIG. 3, the combustion part 21 of the combustion arrangement 1 comprises a further two circular cylindrical and double-walled drums 23, 25. The drums 23, 25 are arranged concentrically in tandem on the outside of the air inlet pipe 22 and the air ducts or the air chamber 24 with a second, double-walled, radially circular space 42B arranged around air the inlet pipe 22, this space constituting a first part of the air chamber 25. The space 42B extends radially outwards from the said air inlet pipe 23 and connects with this pipe 23 for an even distribution of the secondary air (S) along the entire rear wall 35 of the air chamber 24. The drums 23, 25 are designed to form an outer air inlet pipe 23 and outer air ducts or air chamber 25 for delivery of secondary air (S) to the secondary combustion chamber 26 via secondary air inlet openings 48 in the secondary air distributor 26A, whilst only primary air (P) is delivered to the combustion chamber 16 via air the inlet pipe 22, the air ducts or the air chamber 24 and the primary air inlet openings 43 in the combustion chamber 16. Further spacers 57B are also arranged in the air ducts or the air chamber 25. Otherwise the two embodiments are essentially similar in construction.

Figure 5:
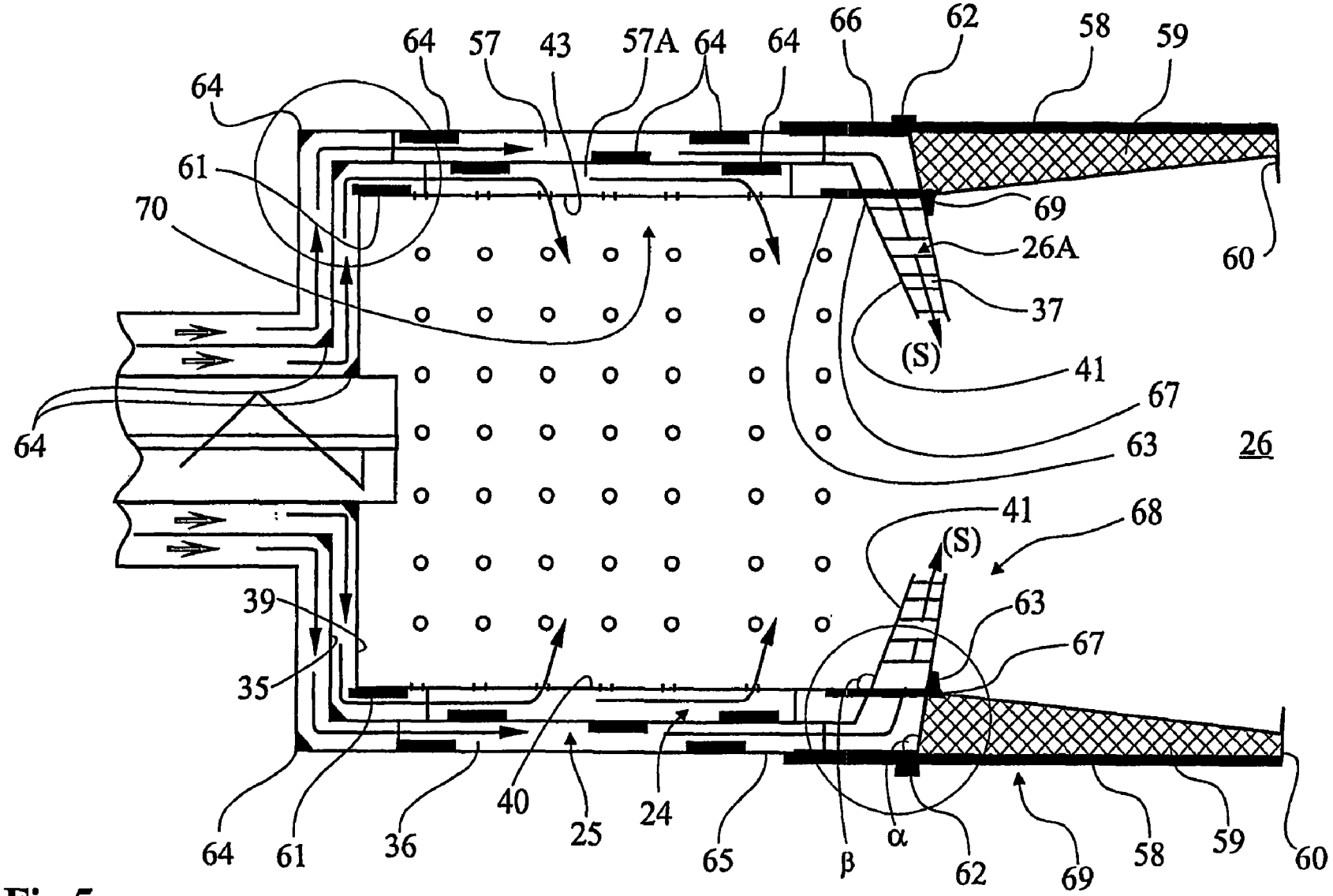
FIG. 5 in a diagrammatic cross-section shows selected parts of a third embodiment of the combustion arrangement according to FIG. 1, the third embodiment comprising a secondary air distributor which is arranged at a certain angle to the combustion chamber and in which the combustion chamber inner parts are arranged so that they can be dismantled in order to facilitate maintenance of the combustion arrangement. The said FIG. 5 also shows two circled details containing fasteners, which are described in more detail in the description below.

FIG. 5 shows a third embodiment of the combustion arrangement 1 according to the invention, which essentially corresponds with the two previous embodiments shown with regard to the various details of the combustion arrangement 1. This third embodiment however, comprises an easily dismantled inner construction in the form of a detachable insert 68 for more efficient replacement and servicing of wearing parts of the combustion arrangement 1. The term wearing parts is here taken to mean the parts which have the shortest service lives, generally the parts that are exposed to the highest temperatures, that is to say, for example, the inner boundary walls 39, 40, 41 of the combustion chamber 16, the secondary air distributor 26A and also the secondary combustion chamber 26.

In order to achieve the aforementioned facility for dismantling a number of fasteners 61, 62, 63 are detachably arranged between radial and cylindrical inner boundary walls 39, 40 of the combustion chamber 16, and possibly also between the walls 35 and 36 between the air ducts for primary air and for secondary air 24, 25 in the second embodiment shown in FIG. 3. The fasteners 61, 62, 63 may take the form, for example, of a number of hooks 61, which are designed to grip in or around the edges of the rear boundary wall(s) 39, 35, depending on which of the embodiments is intended, that is to say according to FIG. 2 or according to FIG. 3, a screw connection 62 and flat bar 63. In the embodiment shown in FIG. 5 the secondary combustion chamber 26 is fitted to the outside 65 of the air duct 25 by means of a number of dismantleable screw connections 62 through the collar 66 of the secondary combustion chamber. In order to further reinforce the construction a number of flat bars 63 are arranged through openings 67 in the edge flanges 41, 37, which flat bars 63 detachably connect the secondary combustion chamber 26 to the combustion chamber 16, the bars being bent, for example.

In the embodiment shown the detachable inset 68 comprises two separate parts 69, 70 that can be detached from one another. The first inset part 69 comprises the secondary combustion chamber 26 with the collar 66. The second inset part 70 comprises the secondary air distributor 26A and the inner boundary wall 40 of the combustion chamber 16. Other configurations may also exist, for example the outer edge flange 37 may instead be fixed to the secondary combustion chamber 26 and the first inset part 69 may, for example, also comprise the wall 36, that is to say the air duct 25. The spacers 57 are fixed, suitably by welded joints 64, to the walls 36, 65 in such a way that the inset 68 can be released. In the embodiment shown in FIG. 5 the second inset 70 is detachably arranged in relation to the wall 39, the spacer 57*a* and between the secondary air distributor 26A and the air duct 25, while the first inset part 69 is detachably arranged in relation to the secondary air distributor 26A and the wall 65.

Figure 6:
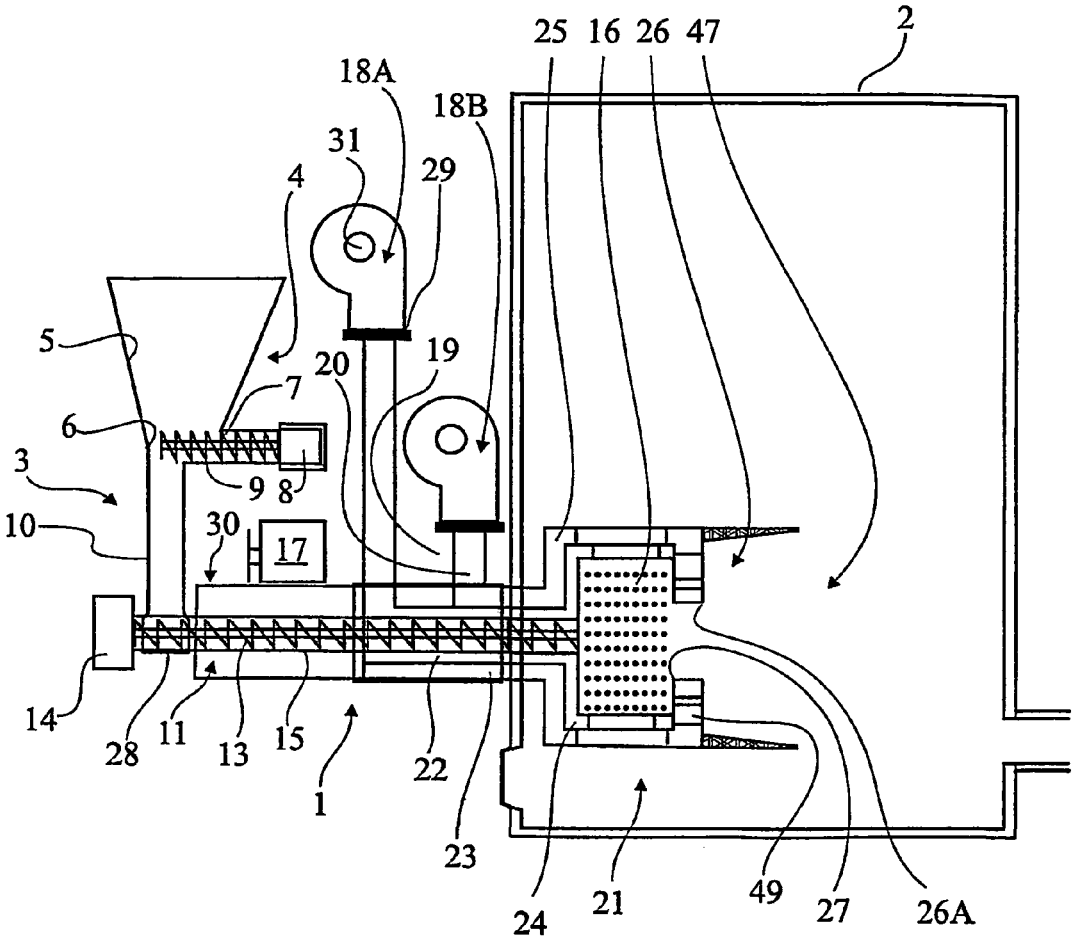
FIG. 6 is a diagrammatic cross-section corresponding to FIG. 1 and showing a further advantageous embodiment of the invention.

FIG. 6 shows an embodiment in which the combustion arrangement is provided with two blowers 18*a*, 18*b*. A first blower 18*a* is designed to blow primary air through an inner chamber 24 into the combustion chamber 16. A second blower 18*b* is designed to blow in secondary air through an outer chamber 25. In this way it is easy to regulate the ratio between primary air and secondary air. 20% to 40% of primary air and 60 to 80% of secondary air are suitably used.

OPERATING DESCRIPTION

In the embodiments shown in the figures the function and use of the combustion arrangement 1 according to the invention are as follows.

The fuel, the primary air (P) and secondary air (S) are essentially delivered to the combustion part 21 in the known way and this will therefore not be described in more detail here.

A defined quantity of fuel is fed into the combustion chamber 16 by the fuel feed device 11 and forms a preferably slowly or intermittently rotating fuel bed 45. Primary air (P) from the blower 18 is fed into the combustion chamber 16 via the air ducts or the air chamber 24 and on out through the air inlet openings 43. Secondary air (S) from the blower 18 is delivered to the secondary combustion chamber 26 via secondary air inlet openings 48 of the secondary air distributor 26A, either via the same air ducts or air chamber 24 (according to the embodiment shown in FIG. 2) or via the further air ducts or the air chamber 25 arranged radially outside the—in this case—radially inner air ducts or the air chamber 24 (according to the embodiment shown in FIG. 3).

The rotation of the combustion chamber 16 mixes the fuel and the primary air (P) efficiently, the majority of the fuel being gasified through primary combustion primarily to combustion gases, a fly ash fraction and a smaller quantity of slag. The continued rotation causes any unburned residues of the fuel and the slag to be discharged from the combustion chamber 16, whilst the combustion gases formed by primary combustion in the combustion chamber 16 and the fly ash are carried out through the outlet 27 from the combustion chamber 16 through the secondary air distributor 26A into the secondary combustion chamber 26 by the air flow made up of the primary air (P) and the secondary air (S).

The preferably intensive blown expulsion of secondary air (S) through secondary air inlet openings 48 and the location, number and shape of the fan blades 49B create a powerful air vortex 50 (which is also boosted if the secondary air distributor 26A rotates), which is directed radially inwards towards the common axis of rotation 33 and which also forcibly blows these residues and gases out of the secondary combustion chamber 26 and over to the boiler space 12 of the boiler 2, where the fly ash is precipitated in the ash container of the boiler 2. At the same time the said residues are also very efficiently gasified into further combustion gases and fly ash. A smaller part may be gasified in the secondary air distributor 26A, whilst the majority of the combustible substances still remaining are gasified in the air vortex 50 outside the secondary air distributor 26A in the form of a concentrated flame jet, in which the combustion gases are also burnt, generating heat, which prevents the fly ash formed in the combustion being converted to sinter deposits inside the actual combustion arrangement 1.

ALTERNATIVE EMBODIMENTS

The invention is not limited to the embodiment shown but can be modified in various ways within the scope of the claims.

The aforementioned dispensing unit 3, fuel feed device 11 and the fuel conveyor (not shown) may therefore also comprise a plurality of separate fuel stores 4 and/or screw conveyors 7, 13 for feeding different fuels, just as further types of known fuel conveying device other than the screw conveyors 7, 13 can naturally also be used in a combustion arrangement 1 according to the invention.

What is claimed is:

1. Arrangement (1) for the combustion of granular, solid fuel comprising:

a combustion chamber (16);

a dispensing unit (3) for feeding the fuel into the combustion chamber (16) via a fuel feed pipe (15) which opens into a centre of rotation of the combustion chamber (16);

air inlets (22, 23) with blower (18) for the delivery of primary air (P) to the combustion chamber (16) via at least one air duct or air chamber (24, 25) in order to produce a flow of air through the combustion chamber (16) and the fuel for a primary combustion of the fuel to combustion gases, and for the delivery of secondary air (S) to a secondary combustion chamber (26) via a secondary air distributor (26A) in order to produce a secondary combustion of the combustion gases formed in the primary combustion;

a common outlet (47) for the primary air (P), the combustion gases and the secondary air (S) from the secondary combustion chamber (26) to a boiler space (12) in a boiler (2) for transmitting the heat from the said primary and secondary combustion to the heat supply system of the boiler (2); and the secondary air distributor (26A) being designed to deliver the secondary air radially inwards towards the centre of the secondary combustion chamber (26) so that combustion is concentrated at a distance from walls of the secondary combustion chamber (26);

wherein at least the combustion chamber (16) is rotatable;

wherein the secondary air distributor also comprises a fan (49) for producing an air and combustion gas vortex (50) inside the secondary combustion chamber (26) and on out through the outlet (47) to the boiler space (12).

2. Combustion arrangement according to claim 1, characterized in that the secondary air distributor (26A) also comprises an inner edge flange (41) in the form of an annular edge flange (41) and an outer edge flange (37), between which flanges the secondary air is led and directed radially inwards.

3. Combustion arrangement according to claim 1, characterized in that the combustion arrangement (1) also comprises a drive motor (17) for a continuous or intermittent rotation of the fan (49).

4. Combustion arrangement according to claim 3, characterized in that the drive motor (17) is also designed to rotate the combustion chamber (16) and the secondary combustion chamber (26).

5. Combustion arrangement according to claim 1, characterized in that the fuel feed pipe (15), the combustion chamber (16), the existing air inlets (22, 23) and the air chambers (24, 25) are arranged concentrically in relation to one another with a common axis (33).

6. Combustion arrangement according to claim 1, characterized in that the fan (49) comprises a plurality of fan blades (49B) which are arranged in the secondary air distributor (26A).

7. Combustion arrangement according to claim 6, characterized in that the fan blades (49B) are arranged around the circumference of the secondary air distributor (26A).

8. Combustion arrangement according to claim 6, characterized in that the fan blades (49B) have a certain defined axial plane along the axis of rotation (33).

9. Combustion arrangement according to claim 6, characterized in that the fan blades (49B) have a certain defined radial angle to a plane along the axis of rotation (33).

10. Combustion arrangement according to claim 1, characterized in that the combustion arrangement (1) comprises separate air ducts or air chambers (24, 25) for the primary air (P) and the secondary air (S).

11. Combustion arrangement according to claim 1, characterized in that at least the combustion chamber (16) has internal cross-section which is polygonal.

12. Combustion arrangement according to claim 1, characterized in that at least the combustion chamber (16) has internal cross-section which is provided with longitudinal or helical vanes for tumbling the fuel as the combustion chamber (16) rotates.

13. Combustion arrangement according to claim 1, characterized in that the combustion arrangement (1) comprises two circular cylindrical drums (23, 25) which are arranged concentrically in tandem on the outside of the air inlet (22), the air ducts or the air chamber (24) respectively in order to form an outer air inlet (23) and outer air ducts or air chamber (25) for the delivery of secondary air (S) to the secondary combustion chamber (26) via the secondary air distributor (26A), while only primary air (P) is delivered to the combustion chamber (16) via the air inlet (22) and the air ducts or the air chamber (24).

14. Combustion arrangement according to claim 1, characterized in that the secondary air distributor (26A) comprises an inner and an outer edge flange (41, 37), which inner edge flange (41) and inner boundary wall (40) of the combustion chamber (16), and outer edge flange (37) and outer wall (36) of the combustion part (21) are respectively arranged at a certain angle ($\alpha$, $\beta$) to one another of between approximately 90° and 180°.

15. Combustion arrangement according to claim 14, wherein the angles ($\alpha$, $\beta$) are between approximately 90° and 135°.

16. Method for the combustion of granular fuel, the method comprising the steps of:

a. providing a combustion chamber (16) with an outlet end, b. providing a fuel feed pipe (15) which opens into a centre of rotation of the combustion chamber (16), c. providing a secondary combustion chamber (26) connected to the outlet end of the combustion chamber (16), the secondary combustion chamber (16) having walls, d. at least intermittently rotating at least the combustion chamber (16)

e. delivering fuel through the fuel feed pipe (15) to the combustion chamber (16) so that the fuel is delivered centrally into the combustion chamber (16), f. delivering a primary air flow to the combustion chamber (16), g. combusting fuel in the combustion chamber (16) and h. delivering a secondary air flow at the outlet end of the combustion chamber (16), the secondary air flow being delivered around the periphery of the outlet end of the combustion chamber (16) and being directed radially inwards towards the centre of the secondary combustion chamber (26) so that further combustion takes place at a distance from the walls of the secondary combustion chamber (26);

wherein the second air flow is fed through a fan (49) in which it is blown radially inwards towards the centre of the secondary combustion chamber;

wherein the quantity of air is controlled by means of blowers so that of the total the air flow, 20% to 40% is made up of primary air and 60% to 80% of secondary air.

17. Arrangement (1) for the combustion of granular, solid fuel comprising:

a combustion chamber (16);

a dispensing unit (3) for feeding the fuel into the combustion chamber (16) via a fuel feed pipe (15) which opens into a centre of rotation of the combustion chamber (16);

air inlets (22, 23) with blower (18) for the delivery of primary air (P) to the combustion chamber (16) via at least one air duct or air chamber (24, 25) in order to produce a flow of air through the combustion chamber (16) and the fuel for a primary combustion of the fuel to combustion gases, and for the delivery of secondary air (S) to a secondary combustion chamber (26) via a secondary air distributor (26A) in order to produce a secondary combustion of the combustion gases formed in the primary combustion;

wherein the air inlets (22, 23) surround the fuel feed pipe (15) and the combustion chamber (16) such that they blow the primary air (P) radially inwards into the combustion chamber;

a common outlet (47) for the primary air (P), the combustion gases and the secondary air (S) from the secondary combustion chamber (26) to a boiler space (12) in a boiler (2) for transmitting the heat from the said primary and secondary combustion to the heat supply system of the boiler (2); and the secondary air distributor (26A) being designed to deliver the secondary air radially inwards towards the centre of the secondary combustion chamber (26) so that combustion is concentrated at a distance from walls of the secondary combustion chamber (26).

18. Combustion arrangement according to claim 17, characterized in that the secondary air distributor also comprises a fan (49) for producing an air and combustion gas vortex (50) inside the secondary combustion chamber (26) and on out through the outlet (47) to the boiler space (12).

19. Combustion arrangement according to claim 17, characterized in that the secondary air distributor (26A) also comprises an inner edge flange (41) in the form of an annular edge flange (41) and an outer edge flange (37), between which flanges the secondary air is led and directed radially inwards.

20. Combustion arrangement according to claim 18, characterized in that the combustion arrangement (1) also comprises a drive motor (17) for a continuous or intermittent rotation of the fan (49).

21. Combustion arrangement according to claim 20, characterized in that the drive motor (17) is also designed to rotate the combustion chamber (16) and the secondary combustion chamber (26).

22. Combustion arrangement according to claim 17, characterized in that the fuel feed pipe (15), the combustion chamber (16), the existing air inlets (22, 23) and the air chambers (24, 25) are arranged concentrically in relation to one another with a common axis (33).

23. Combustion arrangement according to claim 18, characterized in that the fan (49) comprises a plurality of fan blades (49B) which are arranged in the secondary air distributor (26A).

24. Combustion arrangement according to claim 23, characterized in that the fan blades (49B) are arranged around the circumference of the secondary air distributor (26A).

25. Combustion arrangement according to claim 23, characterized in that the fan blades (49B) have a certain defined axial plane along the axis of rotation (33).

26. Combustion arrangement according to claim 23, characterized in that the fan blades (49B) have a certain defined radial angle to a plane along the axis of rotation (33).

27. Combustion arrangement according to claim 17, characterized in that the combustion arrangement (1) comprises separate air ducts or air chambers (24, 25) for the primary air (P) and the secondary air (S).

28. Combustion arrangement according to claim 17, characterized in that at least the combustion chamber (16) has internal cross-section which is polygonal.

29. Combustion arrangement according to claim 17, characterized in that at least the combustion chamber (16) has internal cross-section which is provided with longitudinal or helical vanes for tumbling the fuel as the combustion chamber (16) rotates.

30. Combustion arrangement according to claim 17, characterized in that the combustion arrangement (1) comprises two circular cylindrical drums (23, 25) which are arranged concentrically in tandem on the outside of the air inlet (22), the air ducts or the air chamber (24) respectively in order to form an outer air inlet (23) and outer air ducts or air chamber (25) for the delivery of secondary air (S) to the secondary combustion chamber (26) via the secondary air distributor (26A), while only primary air (P) is delivered to the combustion chamber (16) via the air inlet (22) and the air ducts or the air chamber (24).

31. Combustion arrangement according to claim 17, characterized in that the secondary air distributor (26A) comprises an inner and an outer edge flange (41, 37), which inner edge flange (41) and inner boundary wall (40) of the combustion chamber (16), and outer edge flange (37) and outer wall (36) of the combustion part (21) are respectively arranged at a certain angle ($\alpha$, $\beta$) to one another of between approximately 90° and 180°.

32. Combustion arrangement according to claim 31, wherein the angles ($\alpha$, $\beta$) are between approximately 90° and 135°.

* * * * *